US007243796B2

(12) United States Patent
Grablick

(10) Patent No.: US 7,243,796 B2
(45) Date of Patent: Jul. 17, 2007

(54) CONSUMER PRODUCT DISPLAY

(75) Inventor: Adam Grablick, Minnetonka, MN (US)

(73) Assignee: General Mills, Inc., Minneapolis, MN (US)

( * ) Notice: Subject to any disclaimer, the term of this patent is extended or adjusted under 35 U.S.C. 154(b) by 324 days.

(21) Appl. No.: 10/662,769

(22) Filed: Sep. 15, 2003

(65) Prior Publication Data

US 2005/0055859 A1 Mar. 17, 2005

(51) Int. Cl.
*B65D 73/00* (2006.01)

(52) U.S. Cl. ..... 206/460; 206/461; 206/466

(58) Field of Classification Search ..... 206/460, 206/461, 466, 813, 810, 820
See application file for complete search history.

(56) References Cited

U.S. PATENT DOCUMENTS 2,042,672 A * 6/1936 Maclean ..... 40/534
2,476,774 A * 7/1949 Sears ..... 426/307
3,029,939 A * 4/1962 Feldman ..... 206/466
3,099,352 A * 7/1963 Aven ..... 206/466
3,389,784 A * 6/1968 Hendricks et al. ..... 206/573
3,458,037 A * 7/1969 Larson ..... 206/466
5,025,923 A * 6/1991 Okui ..... 206/714
5,366,777 A * 11/1994 Bown et al. ..... 428/43
6,279,819 B1 * 8/2001 Schultz ..... 229/117.14
2004/0020818 A1 * 2/2004 Chandaria ..... 206/460

FOREIGN PATENT DOCUMENTS

CH 677 095 A5 * 4/1991
EP 0 560 374 A2 * 3/1993

* cited by examiner

*Primary Examiner*—David Fidei
(74) *Attorney, Agent, or Firm*—John A. O'Toole; Timothy A. Czaja; Douglas J. Taylor

(57) ABSTRACT

The present invention relates to a consumer product display comprising of a display strip and a plurality of consumer products. The display strip defines a front face and a back face that combine to define a lower section and an upper section. The upper section includes a hanging means. The front face, at the lower section thereof, is characterized by an exposed adhesive, to which the plurality of consumer products is separately and removably maintained.

30 Claims, 7 Drawing Sheets

CONSUMER PRODUCT DISPLAY

BACKGROUND

The present invention relates to a product display for merchandising consumer products. In particular, the present invention relates to a consumer product display including a plurality of consumer products and a display strip capable of vertically supporting the plurality of products while allowing consumer removal of an individual product.

Products are presented to consumers in a wide variety of packages. Packages may take the form of containers, tubes, or bags and others. Additionally, the packaging can be made from a myriad of materials such as foil, paper, or plastic. The packaging of a particular product might be influenced by such factors as how perishable a product is, the weight of a product, or the overall volume of a product. The present invention addresses one choice-of-packaging factor—the manner or means by which a product will be displayed for merchandising. In particular, the present invention seeks to optimize packaging and retailer costs through an innovation in the manner by which packaged products are displayed for merchandising.

A familiar and effective merchandising technique consists of hanging or otherwise vertically displaying a product, which a consumer can later remove from a display for purchase. In the past, manufacturers have included a peg-hole or other hanging means in a product or its package to facilitate product display and merchandising via a hanging wire or other support member provided at the point of purchase. However, incorporating a peg-hole or similar means into the package requires increased packaging material and increased package processing, which translates into increased costs. Often times, only a few products are actually put on hanging display while the majority of product remains racked or shelved nearby. In those instances there is no need for all products to incorporate peg-holes or other hanging means in the package. Furthermore, incorporation of a peg-hole or other display aid may interfere with such package requirements as hermetic seals or even overall aesthetic appeal. In addition, packages incorporating peg-holes must be individually hanged on separate hanging wires. This may be cumbersome for the retailer and ultimately a limiting factor in the merchandising of a particular product.

A solution to some of these problems has been the use of small adhesive tabs or "hangers" with incorporated peg-holes. In the past, these hangers have been attached to either an individually packaged product or individually packaged products that have been shrink-wrapped or otherwise packaged together for subsequent hanging from a hanging wire. A retailer or manufacturer may simply apply the adhesive hanger to the packaged product, thus obviating the need to incorporate a peg-hole into the packaging itself. These adhesive hangers free package designs from some of the limitations associated with incorporated peg-holes or other display means, but problems remain.

One problem with adhesive hangers lies with their inability to support more than one individually packaged product. As a result, each package of products to be displayed requires its own hanger. In turn, a large quantity of these hangers may be required to display a sufficient number of packages. Also, the adhesive hangers still require a merchandiser to individually hang packages on separate hanging wires. This adds to overall display costs, which may limit the display capability of a merchandiser. Yet another problem is the danger of damaging either a package or its adhesive hanger when they are separated from one another. Unfortunately, this danger arises from a failure to optimize the adhesive force for both product removal from, and product support to, the adhesive hanger. Consumer product displays also incorporate problems associated with product shipping, especially in association with products for foreign export. Product displays can present inconvenient handling sizes, a need for overwrapping, shipping fragility, and a myriad of other shipping difficulties.

For the reasons above, a need exists for a cost effective and versatile hangable display capable of removably securing a plurality of consumer products for merchandising. In particular, a need exists for a display strip that minimizes packaging, shipping, and merchandising costs otherwise associated with consumer product displays.

SUMMARY

One aspect of the present invention relates to a consumer product display comprising a display strip and a plurality of consumer products. In one embodiment, the display strip provides for vertical display of the plurality of consumer products. While the present invention is applicable to a wide variety of consumer products, products in bar form are especially well suited for use in consumer product displays of the present invention. In general terms, the display strip defines a front face and a back face that combine to define a lower section and an upper section. The upper section includes a hanging means. The front face, at the lower section thereof, is characterized by an exposed adhesive, to which the plurality of consumer products is separately and removably maintained.

Another aspect of the present invention relates to a method of assembling a consumer product display strip. A preferred embodiment of the display strip includes a template strip and a carrier strip covered with an adhesive. A related method of assembling the template strip and carrier strip includes: providing the template strip and carrier strip, aligning the two strips, and adhering them together. Alignment of the front face of the carrier strip to the back face of the template strip is performed such that at least a portion of the adhesive covering the carrier strip remains exposed in relation to the template strip. The front face of the carrier strip is then adhered to the back face of the template strip via the adhesive.

Yet another aspect of the present invention relates to a kit of parts for displaying a plurality of packaged consumer products. In one preferred embodiment, the kit includes a plurality of consumer products, a template strip, and a carrier strip. One kit embodiment includes a plurality of template strips and carrier strips supplied in a standard shipping container, such as a box, for a particular consumer product. Preferably, the number of products that can be supplied in a shipping container will not be reduced by the inclusion of the strips. In a related vein, an embodiment of the kit includes carrier strips and template strips with a length no greater than twice the longest dimension of a standard shipping container for a particular product. In this manner, no more than one fold is needed in order to incorporate a plurality of strips in the container.

By at least the above stated means, the present invention embodies a cost effective and versatile hangable display. In short, the present invention enables an adhesive display strip capable of removably securing a plurality of individually packaged consumer products for merchandising without the aid of peg-holes in the product package. A more detailed description of the invention and its preferred embodiments is presented below.

BRIEF DESCRIPTION OF THE DRAWINGS

The invention will be further described with reference to the drawing wherein corresponding reference characters indicate corresponding parts throughout the several views of the drawing, and wherein.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the figures being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
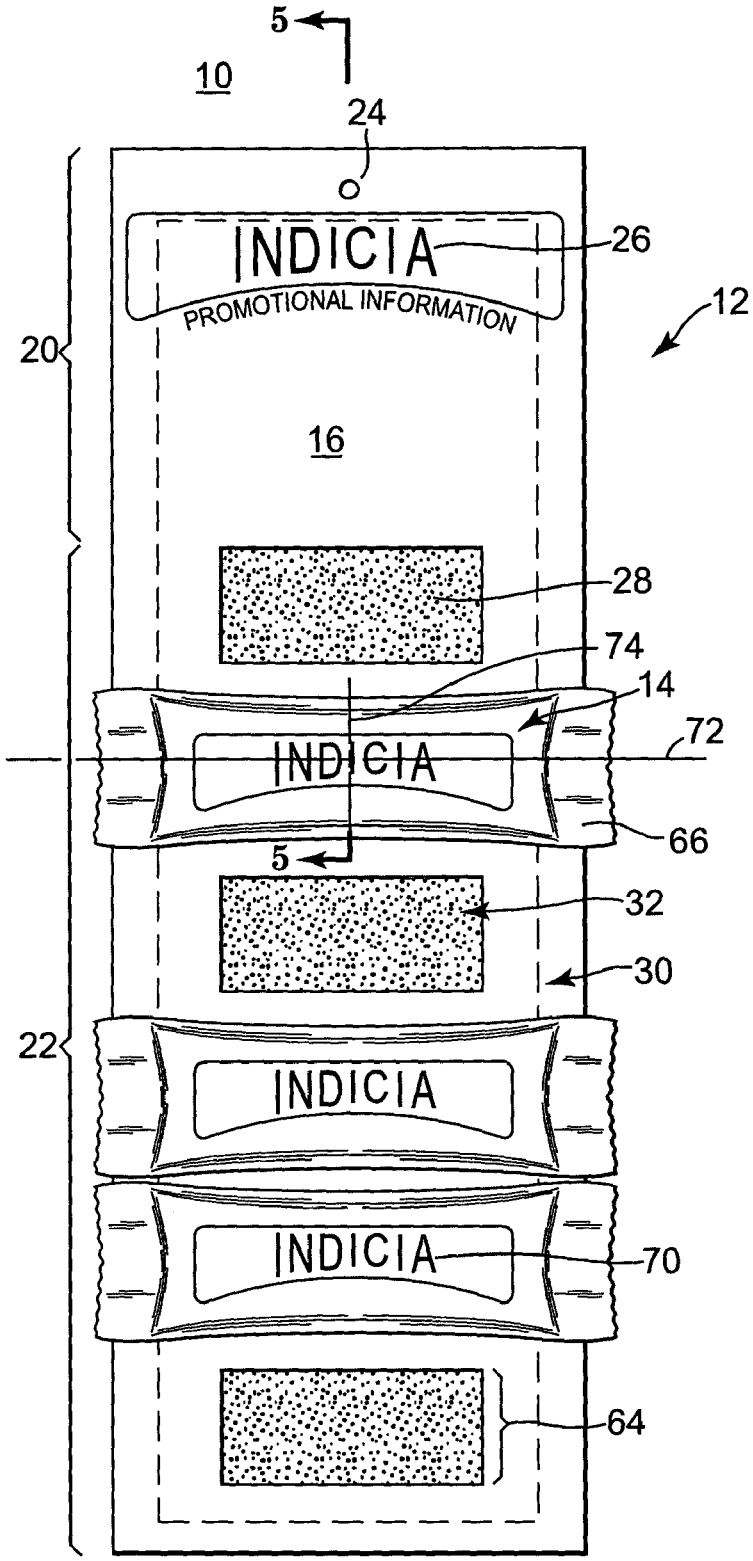
FIG. 1 is a front view of a consumer product display in accordance with the present invention.

One embodiment of a consumer product display 10 in accordance with the present invention is shown in FIG. 1. The consumer product display 10 comprises a display strip 12 and a plurality of consumer products 14 mounted there upon. The components of the display strip 12 are described in greater detail below, however, the display strip 12 can be generally described as defining a front face 16 and a back face 18 (hidden in FIG. 1, but see FIG. 6) combining to form an upper section 20 and a lower section 22. The upper section 20 includes a hanging means 24 and indicia 26. An exposed adhesive 28 characterizes the lower section 22 of the front face 16 to which each of the plurality of consumer products 12 is separately and removably maintained. Upon assembly of the plurality of consumer products 14 to the display strip 12, the product display 10 can be vertically hanged via the hanging means 24.

With the one embodiment of FIG. 1, the display strip 12 includes a template strip 30 and a carrier strip 32. The template strip 30 is illustrated in greater detail in FIG. 2. The template strip 30 is shown in an unfolded state and includes a front face 34 and a back face 36 (hidden in the view of FIG. 3, but see FIG. 6) that combine to form an upper portion 38 and a lower portion 40. The upper portion 38 defines a leading free edge 42 located above an included fold line 44. Additionally, the upper portion 38 includes a first hole 46 and a second hole 48. As will be described in further detail below, these two holes 46,48 can be folded together to provide the hanging means 24 of the display strip 12. The upper portion 38 also incorporates the indicia 26 of the display strip 12. The indicia 26 can include graphics and/or script such as a brand name or mark, a slogan, pricing, graphics, advertising promotional notations (e.g., "New!", "Improved!", "Larger Size!", "Better Flavor!", etc.) or the like. Additionally, the upper portion 38 includes assembly indicia 50 above the fold line 44. The assembly indicia 50 are generally used for assembly of the carrier strip 32 and template strip 30 as described in further detail below. In one preferred embodiment, the upper portion 38 below the fold line 44 is sized to define a surface area of at least 2.5 inches$^2$ (16.1 cm$^2$), and more preferably 3.0 inches$^2$ (19.4 cm$^2$) to provide sufficient area for printing of the indicia 26 at a relatively large size so as to be readily perceived by a consumer.

The lower portion 40 is configured to form a plurality of openings 52 that upon final assembly to the carrier strip 32 (FIG. 1) create the exposed adhesive 28 (FIG. 1). In one embodiment, two longitudinal bands 54 and a plurality of latitudinal bands 56 form a plurality of openings 52 that are generally rectangular in shape and oriented such that the two longer sides of the rectangular shape are arranged horizontally and the two shorter sides are arranged vertically (hereinafter "landscape" in orientation). As will be discussed in further detail below, the openings 52 preferably have dimensions chosen to facilitate a desired adhesion and orientation of each of the plurality of consumable products 14.

Two factors used in materials selection for the template strip 30 include the structural requirements of the display strip 12 and processability of the materials. The template strip 30 generally serves to form the hanging means 24 and a portion of the structure of the display strip 12. Additionally, the template strip 30 must be amenable to indicia 26 printing or rendering and die cutting or other forming processes. Accordingly, the template strip 30 is preferably made from a selection of sheet materials including papers and sheet plastics. For example, a preferred embodiment of the present invention includes a template strip 30 made of a common label stock material, 80# Dull Cover at least 3.5 mils (89 micrometers) and more preferably 4.5 mils (114.3 micrometers) thick (available from Creek Litho, Inc. of Plymouth, Minn.). The label stock material is preferably cut to a total unfolded length between 22.5 inches (57.2 cm) and 23.5 inches (59.7 cm) and to a width between 4.5 inches (11.4 cm) and 5.5 inches (14.0 cm). The fold line 44 is preferably located between 1.0 inches (2.5 cm) and 1.5 inches (3.8 cm) from the leading free edge 42.

Figure 3:
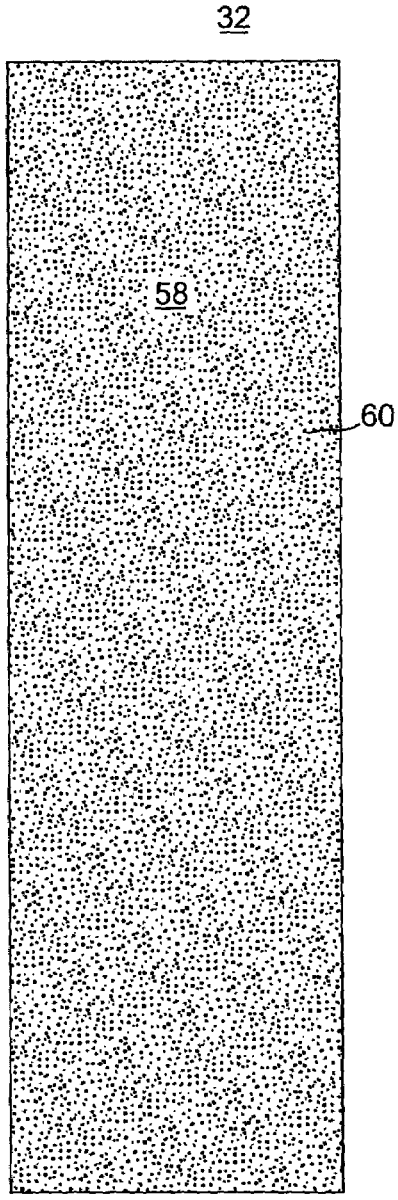
FIG. 3 is a front view of a carrier strip portion of the consumer product display of FIG. 1.

The carrier strip 32 is illustrated in greater detail in FIG. 3. The carrier strip 32 comprises a front face 58 and a back face (hidden in FIG. 3) covered by an adhesive 60. In one respect, the adhesive 60 is chosen to provide a means for removably securing the plurality of consumer products 14 (FIG. 1). In a preferred embodiment, the plurality of products 14 can be secured, removed, and replaced by another one of the plurality of products 14 secured to the display strip 12. In this manner, the adhesive 60 can be reused for a number of times to support one of the plurality of consumable products 14, preferably at least 2 times, and most preferably at least 4 times. In another respect, and as discussed in further detail below, the adhesive 60 is chosen to facilitate assembly of the carrier strip 32 to the template strip 30. As a result, the adhesive 60 is preferably a pressure sensitive adhesive. The characteristics of pressure sensitive adhesives are well known to those skilled in the art as a means of easily adhering two surfaces together without further heating or processing. A pressure sensitive adhesive enables removable and repeated assembly of the plurality of consumer products 14 to the display strip 12. Additionally, a pressure sensitive adhesive allows effective and efficient assembly of the template strip 30 and the carrier strip 32 into the display strip 12 with a minimum of steps. In one preferred embodiment, the adhesive 60 is an acrylic based pressure sensitive adhesive ("Permanent Adhesive" from GPA, INC. of Chicago, Ill.). Alternatively, a wide variety of other adhesives are equally acceptable, such as, for example VHB™ adhesive (available from 3M of Maplewood, Minn.) or other adhesives with similar characteristics.

The carrier strip 32 also forms a portion of the display strip 12 structure and must be compatible with forming processes. Additionally, the carrier strip 32 must be compatible with coating processes or other adhesive deposition techniques. As a result, the carrier strip 32 is preferably made from a selection of sheet materials including papers and sheet plastics. For example, the carrier strip is preferably a common label stock material, 60# White Offset paper having a thickness of at least 2.0 mils (51 micrometers) and more preferably 3.4 mils (86 micrometers) (available from GPA, INC. of Chicago, Ill.). The label stock material is preferably cut to a length between 20.5 inches (52.1 cm) and 21.5 inches (54.6 cm) and to a width between 3.5 inches (8.9 cm) and 4.5 inches (11.4 cm) and includes a Zero Split 80# removable liner (available from GPA, INC. of Chicago, Ill.).

Figure 2:
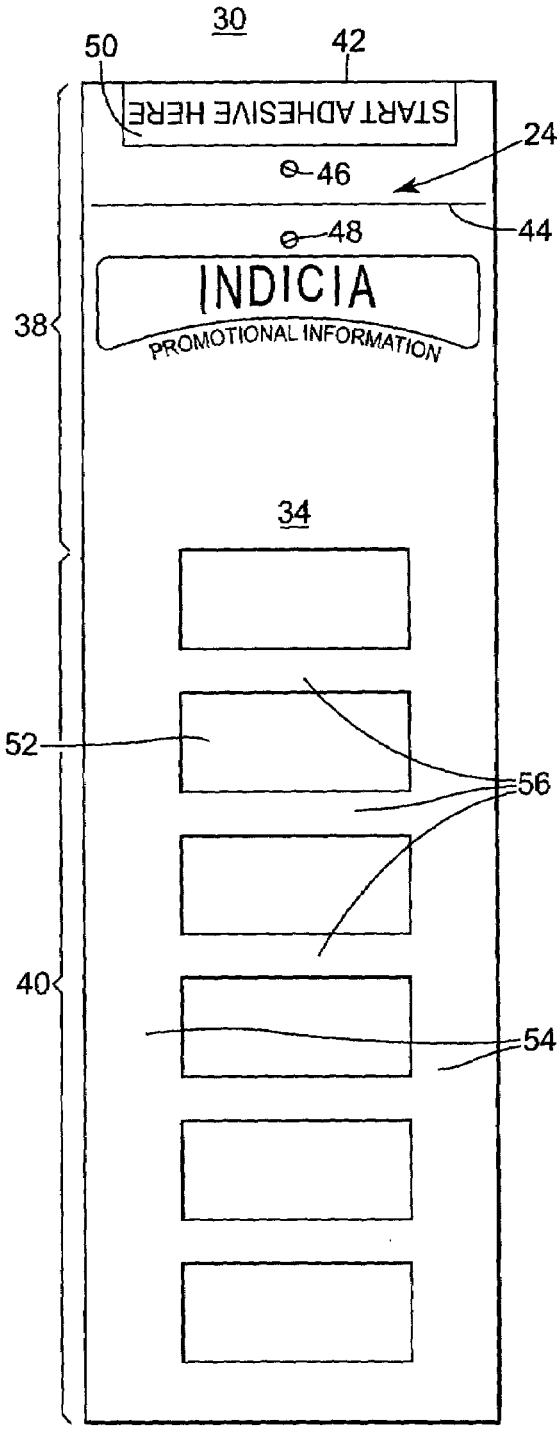
FIG. 2 is a front view of a template strip portion of the consumer product display of FIG. 1 in an unfolded state.
Figure 4A:
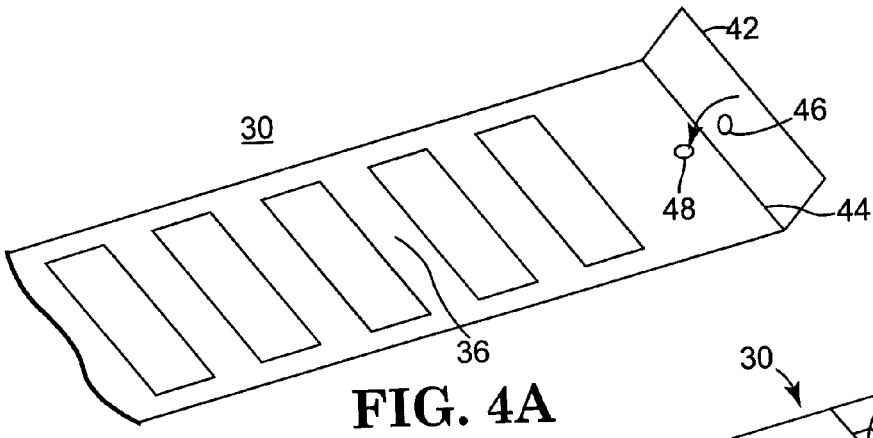
FIGS. 4A–4D illustrate a method of assembling the consumer product display of FIG. 1 in accordance with the present invention.
Figure 4B:
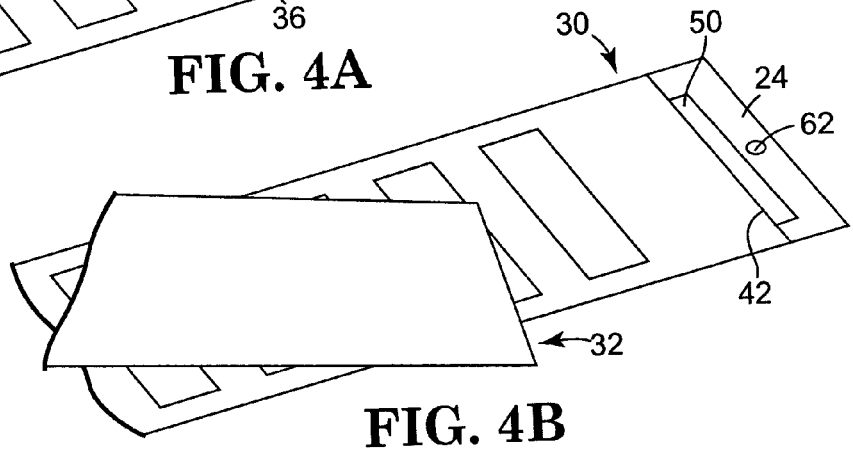

With reference to FIGS. 4A–4D, the consumer product display 10 is assembled as follows. In a preferred embodiment, the upper portion 38 of the template strip 30 is first folded to form the hanging means 24 of the display strip 12. FIG. 4A shows the template strip 30 with the upper portion 38 in a semi-folded state. As previously alluded to, the upper portion 38 includes the first hole 46 located above the fold line 44 and below the leading free edge 42. The second hole 48 is located below the fold line 44 and relative to the first hole 46 such that, in an unfolded state, the two holes 46,48 are linearly aligned perpendicular to the fold line 44 and separated equidistant to the fold line 44. FIG. 4B illustrates the upper portion 38 in a folded state. The leading free edge 42 is folded to the back face 36 of the template strip 30 whereby the first hole 46 and the second hole 48 are aligned to form a continuous hole 62 through the upper portion 38 (FIG. 2).

Also illustrated in FIG. 4B is the general preparation of the carrier strip 32 for adhesion to the template strip 30. In one preferred embodiment, a removable liner (not shown) serves to protect the adhesive 60 on the carrier strip 32 prior to adhering the carrier strip 32 and template strip 30 together. Preferably the liner is removed immediately prior to the alignment step described below. However, in other embodiments, the liner can be removed during alignment or even during adhesion of the carrier strip 32 to the template strip 30. For example, the carrier strip 32 can be provided in a roll format (as adhesive tapes are often supplied) and rolled onto the template strip 30 such that the adhesion step and liner removal step are concurrently performed.

Figure 4C:
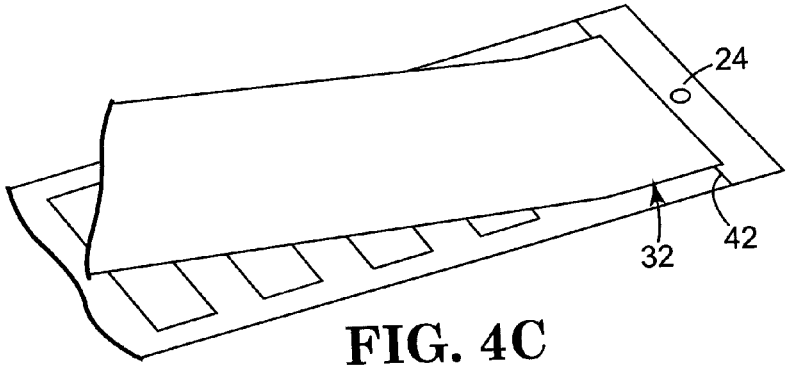

The alignment step is subsequently illustrated in FIG. 4C. The front face 58 of the carrier strip 32 is aligned to the back face 36 of the template strip 30 such that a portion of the adhesive 60 remains exposed relative to the template strip 30. In a preferred method, the adhesive 60 is exposed through the plurality of openings 52 in the template strip 30 to define the exposed adhesive 28 (best shown in FIG. 1). A preferred method also generally includes aligning the carrier strip 32 to the assembly indicia 50 (shown in FIG. 2). With this one configuration, the method further includes aligning the carrier strip 32 to the assembly indicia 50 such that the carrier strip 32 covers the leading free edge 42.

Figure 4D:
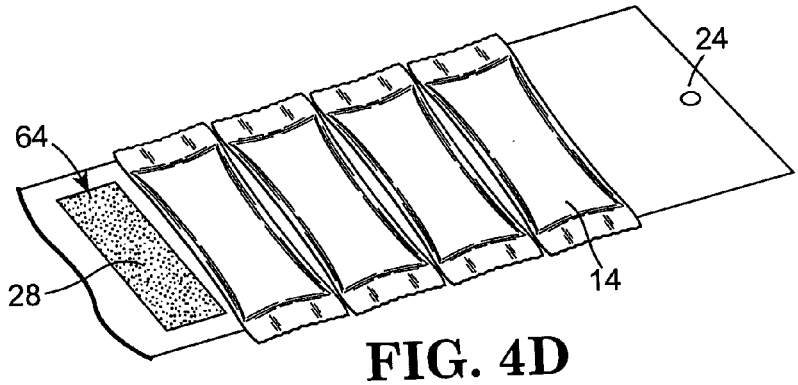

Following alignment, the carrier strip 32 and the template strip 30 are adhered together via portions of the adhesive 60 (FIG. 3) to form the display strip 12. FIG. 4D illustrates the carrier strip 32 and the template strip 30 adhered together with the leading free edge 42 of the template strip 30 adhered to the back face 36 (not shown) of the template strip 30. In the preferred embodiment, each of the plurality of consumer products 14 is then assembled to the display strip 12 via the exposed adhesive 28. Upon final assembly, the display strip 12 resists curling or twisting which might be associated with mild breezes or temporary air movement such as those created by proximate customer movement. In the preferred embodiment, the materials supplying the display strip 12 structure characterize the display strip 12 as flexible, but semi-rigid even when all of the plurality of consumer products 12, or nearly all, have been removed. In this manner, a retailer or merchandiser assembles a complete product display 10 able to properly display consumer products 12 throughout its use.

Figure 5:
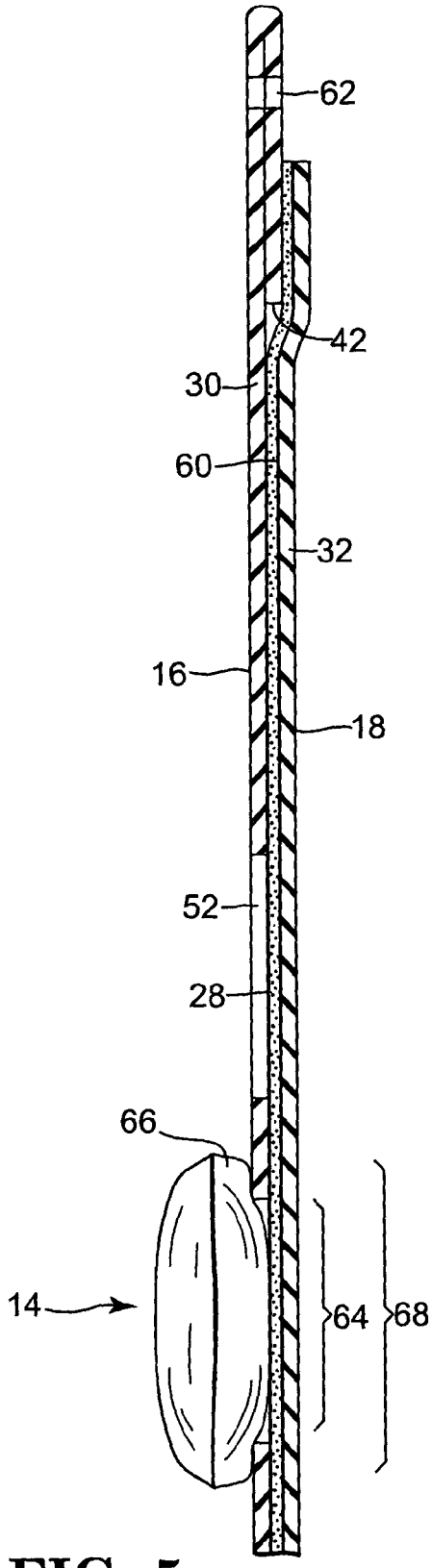
FIG. 5 is an enlarged cross-sectional view of the consumer product display along line 5—5 of FIG. 1.
Figure 6:
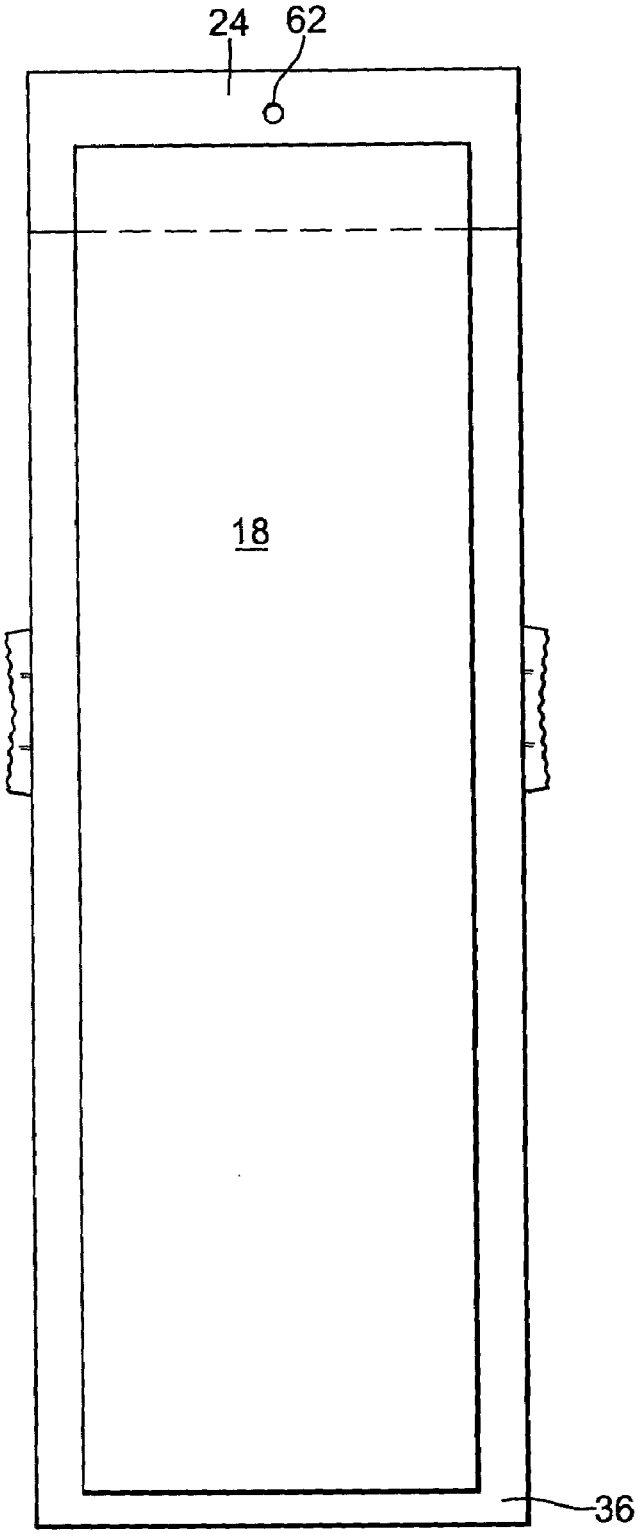
FIG. 6 is a back view of the consumer product display of FIG. 1 including a single, secured consumer product.

Upon final assembly, and as shown in FIGS. 1, 5, and 6, the display strip 12 provides a plurality of product affixing areas 64 for receiving the plurality of consumer products 14, as well as the hanging means 24. As a point of reference, three of the product affixing areas 64 are shown in FIG. 1, whereas an additional three are covered by single ones of the plurality of consumer products 14. The product affixing areas 64 are defined by each of the openings 52 provided by the template strip 30 as previously described. The product affixing areas 64 provide a predetermined area of the adhesive 60 on the carrier strip 32 so as to define the exposed adhesive 28. The preferred interaction between the exposed adhesive 28, the discrete product affixing areas 64, and a product outer package 66 is more clearly shown in FIG. 5.

The shapes of the discrete product affixing areas 64 are partially chosen to promote product removability while also ensuring adhesive strength sufficient for prolonged product support during normal display. The adhesion between the consumer products 14 and the exposed adhesive 28 can be optimized such that the consumer products 14 remain undamaged during removal from the display strip 12. For example, with the embodiment of FIG. 1, the exposed adhesive can be optimized to result in a peel strength less than the maximum tear force of the outer package 30 during removal. However, as a limiting factor, the peel strength cannot be decreased to the point that the consumer products 14 will not remain affixed to the display strip 12 during normal display.

One manner of adjusting the adhesive force between the display strip 12 and each of the plurality of products 14 is to modify or select the composition of the adhesive 60 for adhesive forces. However, the adhesive force supporting each one of the plurality of consumer products 14 is also related to the total contact area of each of the consumer products 14 with the adhesive 60. In the exemplary embodiment of FIG. 5, each of the consumer products 14 has an associated product footprint 68 defined by a contact area between a first one of the plurality of consumer products 14 and the front face 16 of the product display strip 12. It can be seen from FIG. 5 that the each of the plurality of openings 52 in the template strip 30 is sized such that the ratio of the product footprint 68 to the area of exposed adhesive 28 (surface area ratio or SAR) is less than one. The SAR can be further manipulated by increasing or decreasing the total surface area of the exposed adhesive 28 defined by the product affixing area 64. In this manner, the size of the plurality of openings 52 in the template strip 30 can be chosen to vary the adhesive force supplied to support the consumer product 14.

The total area of the exposed adhesive 28 associated with the consumer products 14 relative to the corresponding product affixing areas 64 can be further optimized to promote reliable product removal. In particular, the width of the exposed adhesive 28 perpendicular to a peel direction can be specifically optimized to vary adhesive peel strength. Peel strength is normally measured in pounds per linear inch. As the width of exposed adhesive 28 perpendicular to a peel direction is decreased, so is the peel force required to separate two substrates. Therefore, the width of the product affixing area 64 can be decreased while increasing the length of the product affixing area 64 to maintain the necessary surface area of exposed adhesive 28 supporting the respective consumer products 14. In this manner, peel strength in a desired removal direction can be decreased while retaining sufficient support adhesion. As previously mentioned, in a preferred embodiment the exposed adhesive 28 also provides sufficient support adhesion through a number of reuses.

An additional factor used in choosing shape of the discrete product affixing areas 64 that is unrelated to adhesion is the desired viewing orientation of the consumer products 14 on the display strip 12. In a preferred embodiment, the outer package 66 defines a shape and can include package indicia 70 as shown in FIG. 1. The package indicia 70 can include words or graphics denoting the product identity, characteristics or price. Both the shape and package indicia 70 associated with the consumer products 14 define a generally recognizable conventional viewing orientation of the plurality of consumer products 14. For example, the package indicia 70 include writing that is conventionally read from left to right. Thus, in the preferred embodiment of FIG. 1, the outer package 66 of the consumer products 14 is generally rectangular, defining a major axis 72 and a minor axis 74, and the conventional viewing orientation of the product includes the major axis 72 being arranged horizontally. In an alternative embodiment the conventional viewing orientation of the product includes the major axis 72 being arranged vertically.

Similarly, the shape of each of the plurality of product affixing areas 64 can denote a desired viewing orientation of each of the consumer products 14. In the preferred embodiment of FIG. 1, each of the plurality of product affixing areas 64 is also generally rectangular in shape and landscape in orientation. As a result, the product affixing areas 64 denote a desired viewing orientation that is generally landscape oriented. Therefore, in the preferred embodiment, the conventional viewing orientation of the plurality of consumer products 14 corresponds to the desired viewing orientation defined by the plurality of product affixing areas 64. However, it should be noted that in an alternative embodiment the desired viewing orientation differs from the conventional viewing orientation. In another alternative embodiment, the desired viewing orientations defined by the product affixing areas 64 are not identical.

In light of the above-described relationships, one preferred embodiment includes a plurality of consumer products 14 each of which correspond to one of a plurality of discrete product affixing areas 64 that is rectangular in shape, and configured to provide an exposed adhesive 28 surface area less than the product footprint 68 (SAR<1). In an exemplary embodiment, each of the plurality of consumer products 14 is a cereal bar or granola bar (for example a Nature Valley® Granola Bar available from General Mills, Inc. of Golden Valley, Minn.) having a weight of approximately 21 grams, a rectangular product footprint with dimensions between 4.5 inches (11.4 cm) and 5.5 inches (14.0 cm) in length and between 0.75 inches (1.9 cm) and 2.75 inches (7.0 cm) in width, and a foil based package, 100G OPP/ADH/60G METOPP/PAT Cold Seal Sealant (available from Printpack, Inc., Inc. of Rhinelander, Wis.) including package indicia 70 conventionally viewed in a landscape orientation. In this exemplary embodiment, each of the plurality of consumer products 14 corresponds to a single one of the plurality of discrete product affixing areas 64 each having a rectangular shape and dimensions between 2.5 inches (6.4 cm) and 3.0 inches (7.6 cm) in length and between 1.0 inches (2.5 cm) and 1.5 inches (3.8 cm) in width and defining an SAR of 0.35±0.50.

It is anticipated that a store retailer will use the hanging means 24 included in the upper section 20 of the display strip 12 to merchandise or display more effectively the plurality of consumer products 14. The hanging means 24 in a final assembled state is more clearly shown in FIGS. 5 and 6. In this preferred embodiment, the upper portion 38 of the template strip 30 forms the hanging means 24 of the upper section 20 of the display strip 12. The hanging means 24 is provided with additional structural support by folding the upper portion 38 to provide a single continuous hole 62 through twice the original template strip 30 thickness. For example, one preferred embodiment includes a continuous hole 62 with a diameter between 0.0875 inches (0.2223 cm) and 0.2875 inches (0.7303 cm). Although the preferred embodiment includes a generally circular hole, by no means is the present invention intended to be limited from incorporating additional support material through additional folds or different styles or sizes of hanging means including triangles, hook shapes, ovals, or the like. For instance, a second continuous hole can be included such that the two continuous holes can be used for mounting upon side-by-side pegs. Alternative hanging means can incorporate configurations that supplement or even completely omit holes for hanging. For example, a piece of adhesive initially covered with a protective strip can be mounted upon the backside of the display strip. In yet another example, the hanging means can be practiced by employing a short piece of string with each free end secured to the backside of the display strip 12 such as proximate to fold line 44.

While granola or cereal bars have been described in exemplary embodiments, a multitude of consumer products and especially food or consumable products can comprise the product display 10 of the present invention. It is to be generally understood that one particular product or, possibly, a variety of different consumer products can be included in a single product display 10. These products can be different flavors, sizes, weights and have different conventional viewing orientations, package materials and shapes, and surface area ratios (SARs). As previously described, the shape and size of the discrete product affixing areas 64 can also vary within a single display strip 12 to accommodate the variety of different consumer products 14 of a single consumer product display 10. For example, alternative embodiment consumer product display 10 include consumer products 14 such as: boxed cereals, bagged snack chips, packaged snack bars, yogurt containers or a variety of others (for example, but not limited to, the multitude of consumer products attributable to General Mills, Inc. of Golden Valley, Minn.).

The consumer product display 10 of the present invention can be supplied to retailers and merchandiser for assembly of the display strip 12 and subsequent assembly of the consumer products 14 thereto. As a result, the template strip 30 and carrier strip 32 can be supplied in a shipping container (not shown) filled with the plurality of consumer products 14 as a "kit of parts." In one preferred embodiment, directions for assembly of the consumer product display 10 are also included in the kit of parts. Such kits find particular suitability for use in certain export markets, especially those where small sales volumes and limited shelf display capacity characterize retail sales. The assembly indicia 50 (FIG. 2) will preferably incorporate at least a portion of the set of directions indicating a desired assembly configuration.

In order to minimize shipping costs, the capacity of a shipping container will preferably not be reduced if a plurality of the carrier strips 32 and the template strips 30 are included in the shipping container. In a preferred embodiment, the length, material, and thickness of both the template strip 30 and carrier strip 32 are chosen to prevent such a reduction in capacity. As such, the lengths of the carrier strips 32 and template strips 30 are preferably no more than twice the longest dimensions of the container the kit is supplied in. Longer template strips 30 or carrier strips 32 would have to be folded more than once before being placed in the shipping container. The disadvantages of additional folding include: taking up more space in the shipping container, a less appealing appearance, and possibly a less robust display strip 12 structure. For example, the template strip 30 and the carrier strip 32 of the exemplary embodiment described for use with granola or cereal bars will preferably have a length of no more than 23.25 inches (59.06 cm), more preferably 23.00 inches (58.42 cm). If so provided, a corresponding shipping container of 8.0 inches (20.3 cm) by 11.5 inches (29.2 cm) by 9.5 inches (24.1 cm)(available from Earth Grains of Rome, Ga.) can include a quantity of 16 template strips 32 and 16 carrier strips 34 without reducing the number of consumer products 14 that might otherwise usually be included (for example, 144 Nature Valley® Granola Bars).

Figure 7:
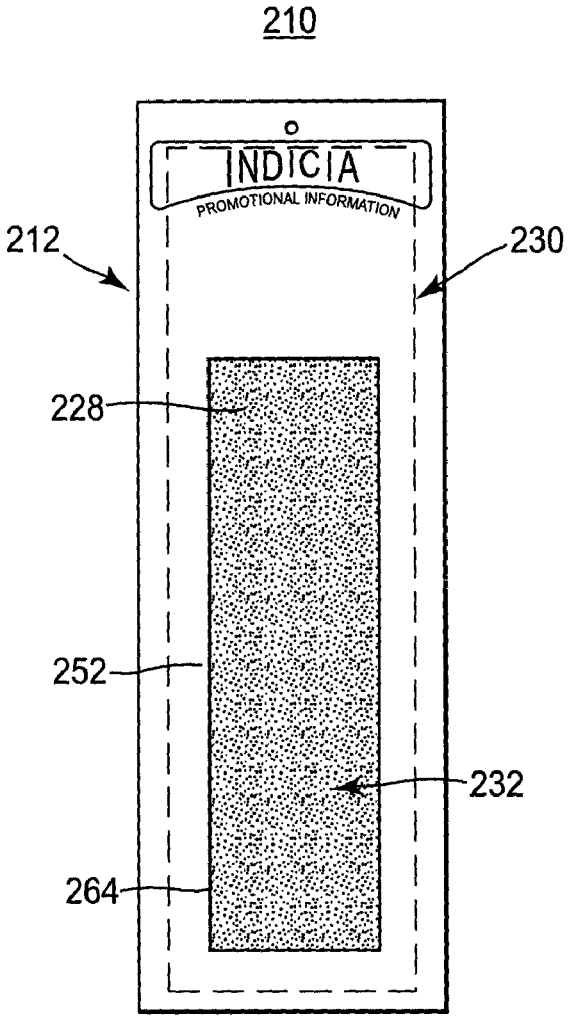
FIGS. 7–9 are front views of alternative embodiment consumer product displays in accordance with the present invention.
Figure 8:
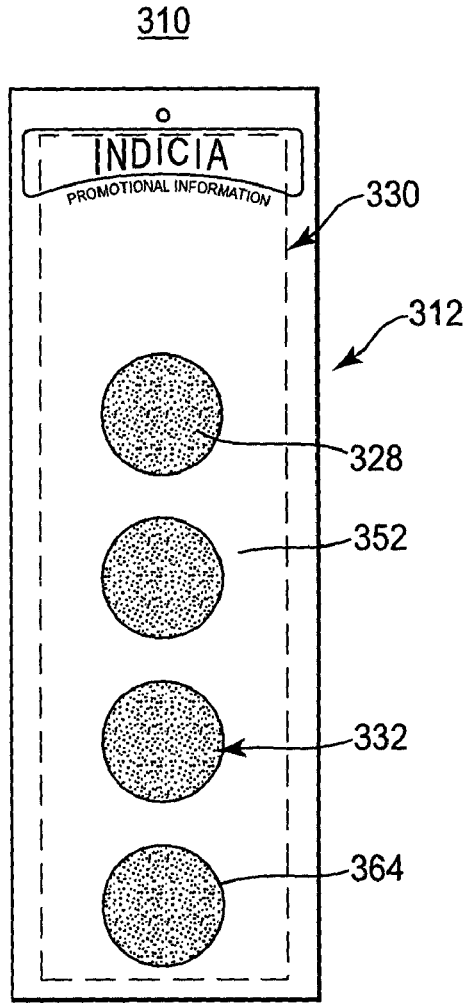

As various changes could be made in the above constructions and methods without departing from the scope of the invention as defined in the claims, it is intended that all matter contained in the description or shown in the accompanying drawings be interpreted as illustrative and not in a limiting sense. As such, several alternative embodiments are proposed within the scope of the present invention. An alternative embodiment consumer product display 210 is shown in FIG. 7 and includes a display strip 212 that is generally comprised of a template strip 230 and a carrier strip 232. However, an exposed adhesive 228 is defined by a single opening 252 in the template strip 230 to form a single discrete product affixing area 264. In this manner, the plurality of consumer products 14 (FIG. 1) can be individually and removably secured on the single discrete product affixing area 264. Another alternative embodiment consumer product display 310, illustrated in FIG. 8, includes a display strip 312 comprising a template strip 330 and a carrier strip 232. A plurality of openings 352 in the template strip 330 form a plurality of discrete product affixing areas 364, each characterized by an exposed adhesive 328, that are generally circular in shape.

Figure 9:
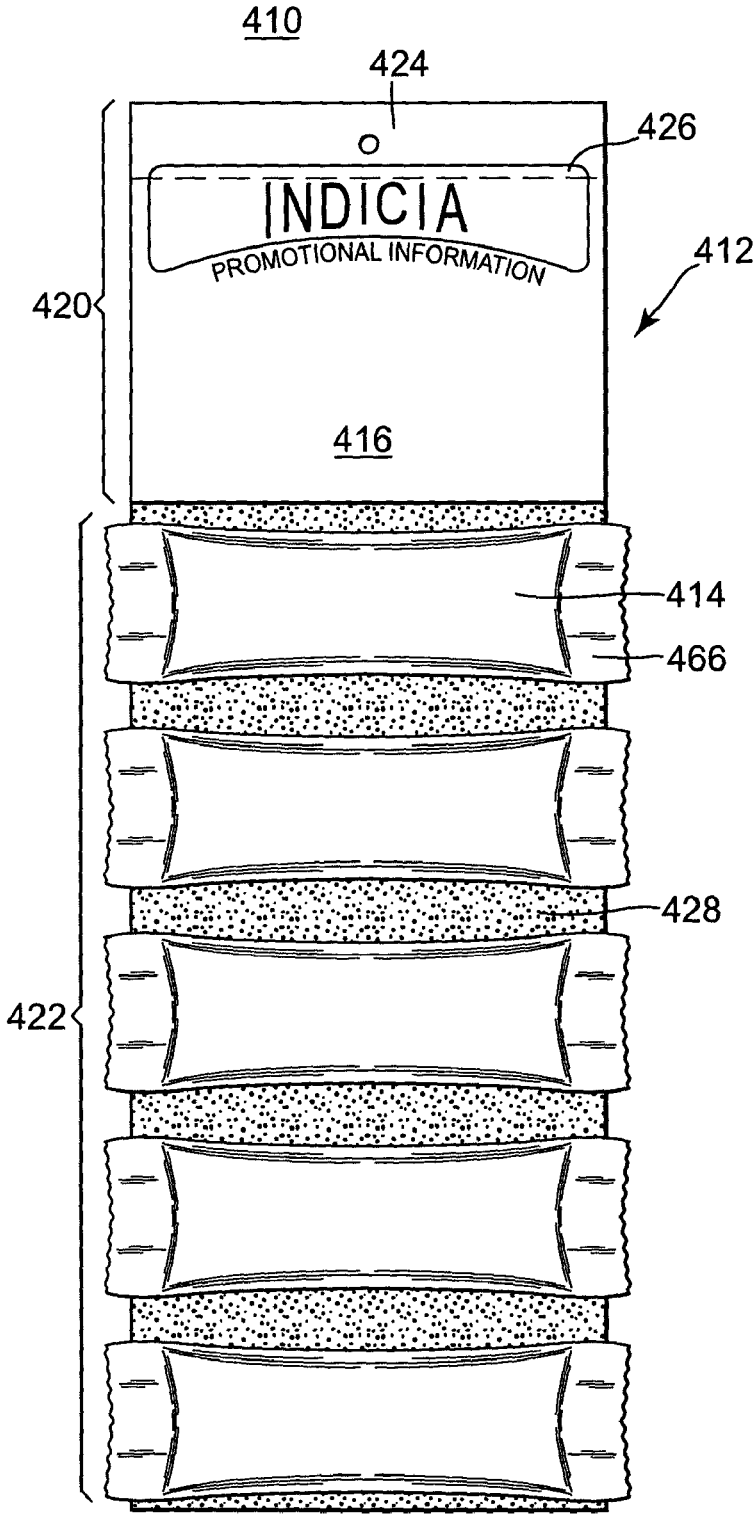

Another alternative embodiment consumer product display, shown in FIG. 9, includes a product display 410 comprising a display strip 412 and a plurality of consumer products 414, each separately and removably adhered to the display strip 412. The display strip 412 generally defines a front face 416, a back face 418, an upper section 420 and a lower section 422. The upper section 420 also includes a hanging means 424 and indicia 426. The lower section 422 of the front face 416 is characterized by an exposed adhesive 428. Additionally, each of the plurality of consumer products 414 includes an outer package 466. Finally, each of the plurality of consumer products 414 are separately and removably adhered to the front face 416 via the exposed adhesive 428. The display strip 412 shown is a single strip not further comprising of a carrier strip and a template strip in contrast to the preferred embodiments described above. Additionally, the width of the lower section 422 might be further reduced to control some of the adhesion between the plurality of consumer products 414 and the display strip 412. Although several embodiments have been described above, the following section outlines several working prototypes within the scope of the present invention and the method of their evaluation.

EXAMPLES AND COMPARATIVE EXAMPLES

Objects and advantages of this invention are further illustrated by the following examples and comparative examples. The particular materials and amounts thereof recited in these examples, as well as other conditions and details, should not be construed to unduly limit the invention.

Several example consumer product displays were assembled and tested for product support and product removability. As described in greater detail below, each sample included a display strip, consisting of a template strip and a carrier strip, providing an exposed adhesive area against which a consumer product was positioned. The exposed adhesive area was varied for several samples by providing differently sized openings in the corresponding template strip (80# Dull Cover paper from Creek Litho, Inc. of Plymouth, Minn. for each example). Additionally, the adhesive coating on the carrier strip was varied for several of the examples to produce different adhesive strengths. Finally, different packaged goods were employed for several of the examples to represent different packaging materials, product weights, and product footprints. Following construction of the display strip, the selected packaged good was then assembled to the exposed adhesive area and left unmolested for five days at ambient conditions. Upon conclusion of the five-day period, a visual inspection was made to evaluate whether a product had traveled or separated from the adhesive. If a product remained properly adhered, it was then separated from the display strip adhesive by manually grasping the outer package and pulling. Each hand pull was then evaluated based upon ease of removal, resultant display strip integrity, and packaging integrity of the removed packaged good product. For each of the listed examples, two samples were prepared and tested to ensure sufficient qualitative testing accuracy.

Example 1

Two sample display strips were prepared using the template strip described above and a carrier strip providing a mid strength acrylic based pressure sensitive adhesive ("Permanent Adhesive" available from GPA, INC. of Chicago, Ill.). An exposed adhesive area corresponding to an SAR of 0.357 was formed by an opening cut in the template strip. A Nature Valley® Granola Bar being 20 grams in weight;

having a metallized foil based outer package; and having a product footprint of approximately 9.6 inches$^2$ (61.9 cm$^2$) was secured to the exposed adhesive area of each display strip, respectively. The samples were then subjected to the above-described testing. In both instances, the Nature Valley® Granola Bar remained adhered to the respective display strip for all five days. Both packaged goods were also successfully removed from the corresponding display strip adhesive without undue difficulty, or display strip or package damage. In sum, Example 1 "passed" the qualitative testing herein described.

Example 2

Two sample display strips were prepared using the template strip described above and a carrier strip providing a high strength acrylic based pressure sensitive adhesive ("Extra Permanent Adhesive" available from GPA, INC. of Chicago, Ill.). An exposed adhesive area corresponding to an SAR of 0.190 was formed by an opening cut in the template strip. A Big G Oatmeal Crisp® packaged good product (available from General Mills, Inc. of Golden Valley, Minn.) being 40 grams in weight; having a metallized foil based outer package as previously described; and having a product footprint of approximately 9.6 inches$^2$ (61.9 cm$^2$) was secured to the exposed adhesive area of each display strip, respectively. The samples were then subjected to the above-described testing. In both instances, the packaged good product remained adhered to the respective display strip for all five days. Both packaged good products were also successfully removed from corresponding the display strip adhesive without undue difficulty or display strip or package damage. Example 2 "passed" the qualitative testing herein described.

Example 3

Two sample display strips were prepared using the template strip described above and a carrier strip providing a low strength acrylic based pressure sensitive adhesive ("Removable Adhesive" available from GPA, INC. of Chicago, Ill.). An exposed adhesive corresponding to an SAR of 0.750 was formed by an opening cut in the template strip. A Big G Oatmeal Crisp® packaged good double bar product (available from General Mills, Inc. of Golden Valley, Minn.) being 80 grams in weight; having a metallized foil based outer package as previously described; and having a product footprint of approximately 9.6 inches$^2$ (61.9 cm$^2$) was secured to the exposed adhesive area of each display strip, respectively. The samples were then subjected to the above-described testing. In both instances, the packaged good product remained adhered to the respective display strip for all five days. Both packaged good products were also successfully removed from the corresponding display strip adhesive without undue difficulty or display strip or package damage. Example 3 "passed" the qualitative testing herein described.

Example 4

Two sample display strips were prepared using the template strip described above and a carrier strip providing a high strength acrylic based pressure sensitive adhesive ("Extra Permanent Adhesive" available from GPA, INC. of Chicago, Ill.). An exposed adhesive area corresponding to an SAR of 0.300 was formed by an opening cut in the template strip. A Betty Crocker® Butter Milk Pancake Mix packaged good product (available from General Mills, Inc. of Golden Valley, Minn.) being 190 grams in weight; having a polyester based outer package; and having a product footprint of approximately 11.5 inches$^2$ (74.2 cm$^2$) was secured to the exposed adhesive area of each display strip, respectively. The samples were then subjected to the above-described testing. In both instances, the packaged good product remained adhered to the respective display strip for all five days. Both packaged good products were also successfully removed from the corresponding display strip adhesive without undue difficulty or display strip or package damage. Example 4 "passed" the qualitative testing herein described.

Example 5

Two sample display strips were prepared using the template strip described above and a carrier strip providing a high strength acrylic based pressure sensitive adhesive ("Extra Permanent Adhesive" available from GPA, INC. of Chicago, Ill.). An exposed adhesive area corresponding to an SAR of 0.350 was formed by an opening cut in the template strip. A Big G Oatmeal Crisp® double bar packaged good product (available from General Mills, Inc. of Golden Valley, Minn.) being 80 grams in weight; having a foil based outer package as previously described; and having a product footprint of approximately 9.6 inches$^2$ (61.9 cm$^2$) was secured to the exposed adhesive area of each display strip, respectively. The samples were then subjected to the above-described testing. In both instances, packaged good product remained adhered to the respective displays strip for all five days. Both examples were also successfully removed from the display strip adhesive without undue difficulty or display strip or package damage. Example 5 "passed" the qualitative testing herein described.

Example 6

Two sample display strips were prepared using the template strip described above and a carrier strip providing a low strength acrylic based pressure sensitive adhesive ("Removable Adhesive" available from GPA, INC. of Chicago, Ill.). An exposed adhesive area corresponding to an SAR of 0.550 was formed by an opening cut in the template strip. A Betty Crocker® Buttermilk Pancake Mix packaged good product (available from General Mills, Inc. of Golden Valley, Minn.) being 190 grams in weight; having a polyester based outer package as previously described; and having a product footprint of approximately 11.5 inches$^2$ (74.2 cm$^2$) was secured to the exposed adhesive area of each display strip, respectively. The samples were then subjected to the above-described testing. In both instances, the packaged good product remained adhered to the corresponding display strip adhesive for all five days. Both package good products were also successfully removed from the display strip adhesive without undue difficulty or display strip or package damage. Example 6 "passed" the qualitative testing herein described.

Comparative Example 1

Two sample display strips were prepared using the template strip described above and a carrier strip providing a low strength acrylic based pressure sensitive adhesive ("Removable Adhesive" available from GPA, INC. of Chicago, Ill.). An exposed adhesive area corresponding to an SAR of 0.200 was formed by an opening cut in the template strip. A Big G Oatmeal Crisp® packaged good product (available from General Mills, Inc. of Golden Valley, Minn.) being 40 grams in weight; having a metallized foil based outer package as previously described; and having a product footprint of approximately 9.6 inches$^2$ (61.9 cm$^2$) was secured to the exposed adhesive area of each display strip, respectively. The samples were then subjected to the above-described testing. In both instances, the packaged good product of Comparative Example 1 failed to remain adhered to the respective display strip for all five days. Therefore, Example 1 "failed" the qualitative testing herein described.

Comparative Example 2

Two sample display strips were prepared using the template strip described above and a carrier strip providing a mid strength acrylic based pressure sensitive adhesive ("Permanent Adhesive" available from GPA, INC. of Chicago, Ill.). An exposed adhesive area corresponding to an SAR of 0.200 was formed by an opening cut in the template strip. A Betty Crocker® Buttermilk Pancake Mix packaged good product (available from General Mills, Inc. of Golden Valley, Minn.) being 190 grams in weight; having a polyester based outer package as previously described; and having a product footprint of approximately 11.5 inches$^2$ (74.2 cm$^2$) was secured to the exposed adhesive area of each display strip, respectively. The samples were then subjected to the above-described testing. In both instances, the packaged good product of Comparative Example 2 failed to remain adhered to the respective display strip adhesive for the five days. Therefore, Comparative Example 2 "failed" the qualitative testing herein described.

The experimental settings and results are presented in tabular format in Table 1.

TABLE 1

| Example/ Product** | SAR | Product Footprint (sq in) | Adhesive Area (sq in) | Adhesive* | Product Weight | Package Material | Result |
|---|---|---|---|---|---|---|---|
| 1/1 | 0.350 | 9.6 (61.9 cm$^2$) | 3.4 (21.9 cm$^2$) | 2 | 20 g | Foil | Pass |
| 2/2 | 0.190 | 9.6 (61.9 cm$^2$) | 1.8 (11.6 cm$^2$) | 3 | 40 g | Foil | Pass |
| 3/3 | 0.750 | 9.6 (61.9 cm$^2$) | 7.2 (46.5 cm$^2$) | 1 | 80 g | Foil | Pass |
| 4/4 | 0.300 | 11.5 (74.2 cm$^2$) | 3.4 (21.9 cm$^2$) | 3 | 190 g | Polyester | Pass |
| 5/3 | 0.350 | 9.6 (61.9 cm$^2$) | 3.4 (21.9 cm$^2$) | 3 | 80 g | Foil | Pass |
| 6/4 | 0.550 | 11.5 (74.2 cm$^2$) | 6.3 (40.6 cm$^2$) | 1 | 190 g | Polyester | Pass |
| Comp 1/2 | 0.200 | 9.6 (61.9 cm$^2$) | 1.9 (12.3 cm$^2$) | 1 | 40 g | Foil | Fail |
| Comp 2/4 | 0.200 | 11.5 (74.2 cm$^2$) | 2.3 (14.8 cm$^2$) | 2 | 190 g | Polyester | Fail |

*Adhesive 1 "Removable Adhesive" available from GPA, INC. of Chicago, IL
*Adhesive 2 "Permanent Adhesive" available from GPA, INC. of Chicago, IL
*Adhesive 3 "Extra Permanent Adhesive" available from GPA, INC. of Chicago, IL
**Product 1: Nature Valley ® Granola Bar
**Product 2: Big G Oatmeal Crisp ® (single bar)
**Product 3: Big G Oatmeal Crisp ® (double bar)
**Product 4: Betty Crocker ® Buttermilk Pancake Mix By at least the above stated means, the present invention embodies a cost effective and versatile hangable display. In short, the present invention enables an adhesive display strip capable of removably securing a plurality of individually packaged consumer products for merchandising without the aid of peg-holes in the product package.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A consumer product display comprising:

a display strip including:

a template strip defining a front face, a back face, an upper portion and a lower portion, a fold line formed in the upper portion such that the upper portion defines a leading free edge above the fold line; and a carrier strip defining a front face and a back face, the front face of the carrier strip being covered with an adhesive;

wherein the front face of the carrier strip is adhered to the back face of the template strip such that at least a portion of the adhesive remains exposed relative to the lower portion of the template strip to define an exposed adhesive; and further wherein the front face of the carrier strip is adhered to the back face of the template strip over the free edge of the upper section to secure the free edge against the back face of the template strip to define hanging means; and a plurality of consumer products, each separately and removably adhered to the exposed adhesive.

2. The consumer product display of claim 1 wherein the lower portion of the template strip defines a plurality of discrete product affixing areas, each characterized by an exposed adhesive.

3. The consumer product display of claim 1, wherein the upper portion of the template strip has a surface area of at least 3 $in^2$.

4. The consumer product display of claim 3, wherein:

a first one of the plurality of consumer products has an associated product footprint defined by a contact area between the first one consumer product and the product display strip, and further wherein the first one of the plurality of discrete product affixing areas is configured to provide an exposed adhesive surface area that is less than the product footprint.

5. The consumer product display of claim 2, wherein each of the plurality of consumer products includes an outer package that resists tearing up to a maximum force, and further wherein each of the discrete product affixing areas is configured to establish an adhesive peel strength that is less than the maximum tear force of the outer package.

6. The consumer product display of claim 2, wherein a first one of the plurality of consumer products includes an outer package, and:

further wherein the outer package includes indicia which define a conventional viewing orientation of the product, and further wherein a first one of the plurality of discrete product affixing areas defines a desired viewing orientation corresponding to the conventional viewing orientation of the first one of the plurality of consumer products.

7. The consumer product display of claim 6, wherein the outer package is generally rectangular defining a major axis and a minor axis, and the conventional viewing orientation of the product includes the major axis being arranged horizontally.

8. The consumer product display of claim 6, wherein the outer package of the first consumer product is generally rectangular defining a major axis and a minor axis, and the conventional viewing orientation of the product includes the major axis being arranged vertically.

9. The consumer product display of claim 6, wherein a shape of the first product affixing area corresponds with a shape of the outer package of the first consumer product.

10. The consumer product display of claim 6, wherein each of the plurality of discrete product affixing areas defines an identical desired viewing orientation.

11. The consumer product display of claim 1, wherein the hanging means includes a hole.

12. The consumer product display of claim 1, wherein the hanging means includes:

a first hole formed in the upper section above the fold line; and a second hole formed in the upper section below the fold line;

wherein the first hole and the second hole are located relative to each other such that when the upper section is in an unfolded state the holes are linearly aligned perpendicular to the fold line and separated equidistant to the fold line, and when the upper section is in a folded state, the leading free edge is folded to the back face whereby the first hole and the second hole form a continuous hole through the upper section.

13. A display strip comprising:

a template strip defining a front face, a back face, an upper portion and a lower portion, a fold line formed in the upper portion such that the upper portion defines a leading free edge above the fold line; and a carrier strip defining a front face and a back face, the front face of the carrier strip being covered with an adhesive;

wherein the front face of the carrier strip is adhered to the back face of the template strip such that at least a portion of the adhesive remains exposed relative to the lower portion of the template strip to define discrete product affixing areas characterized by an exposed adhesive, wherein each of the discrete product affixing areas is substantially similarly sized and shaped, and further wherein the carrier strip is adhered over the free edge of the upper section to secure the free edge against the back face of the template strip to define hanging means.

14. The display strip of claim 13, wherein the exposed adhesive defines a plurality of discrete product affixing areas that are substantially rectangular in shape.

15. The display strip of claim 13, wherein the plurality of discrete product affixing areas is defined by a plurality of openings in the lower portion of the template strip.

16. The display strip of claim 15, wherein the plurality of openings in the lower portion of the template strip is formed by two longitudinal bands that are connected by a plurality of latitudinal bands.

17. The display strip of claim 16, wherein each of the plurality of openings in the lower section of the template strip is generally rectangular in shape and landscape in orientation.

18. The display strip of claim 15, wherein each of the plurality of openings are generally circular in shape.

19. The display strip of claim 13, wherein the adhesive is a pressure sensitive adhesive.

20. The display strip of claim 13, wherein the template strip is formed of paper.

21. The display strip of claim 13, wherein the template strip is from approximately 3.5 mils to approximately 4.5 mils thick.

22. The display strip of claim 21, wherein the template strip is approximately 4.5 mils thick.

23. The display strip of claim 13, wherein the hanging means includes the upper portion having a hole.

24. The consumer product display of claim 1, wherein a total length of the display strip is not greater than approximately twenty-three inches.

25. The consumer product display of claim 1, wherein the upper portion of the template strip includes indicia.

26. A consumer product display comprising:

a display strip including:

a template strip defining a front face, a back face, an upper portion and a lower portion, the upper portion defining a hanging means, the hanging means including:

a fold line formed in the upper section such that the upper section defines a leading free edge above the fold line;

a first hole formed in the upper section above the fold line; and a second hole formed in the upper section below the fold line; and a carrier strip defining a front face and a back face, the front face of the carrier strip being covered with an adhesive;

wherein the front face of the carrier strip is adhered to the back face of the template strip such that at least a portion of the adhesive remains exposed relative to the lower portion of the template strip to define an exposed adhesive; and further wherein the front face of the carrier strip is adhered to the back face of the template strip over the free edge of the upper section to secure the free edge against the back face of the template strip such that the first hole and the second hole in the upper section are substantially aligned; and a plurality of consumer products, each separately and removably adhered to at least one discrete product affixing area via the exposed adhesive.

27. A method of assembling a consumer product display strip that is configured to adhesively secure packaged consumer products in a removable manner comprising:

providing a template strip defining a front face, a back face, an upper portion and a lower portion, the upper portion having a first hole, a second hole, a fold line and a leading free edge above the fold line;

providing a carrier strip defining a front face and a back face, wherein the front face is covered by an adhesive;

folding the upper portion at the fold line such that the leading free edge of the upper portion is folded onto the back face of the template strip such that the first hole and the second hole are coaxially aligned;

aligning the front face of the carrier strip to the back face of the template strip such that at least a portion of the adhesive remains exposed relative the template strip; and covering the leading free edge with the carrier strip; and adhering the front face of the carrier strip to the back face of the template strip via the adhesive such that the leading free edge is adhered against the back face of the template strip.

28. The method of claim 27, wherein the carrier strip includes a removable liner disposed over the adhesive, and wherein assembling the display strip further comprises removing the liner.

29. The method of claim 27, wherein the template strip includes assembly indicia and wherein aligning the carrier strip to the template strip further comprise aligning the carrier strip to the assembly indicia.

30. The method of claim 27, wherein an upper portion of the template strip above the fold line includes assembly indicia and wherein covering the leading free edge with the carrier strip further comprises aligning the carrier strip to the assembly indicia.

* * * * *